US008864269B2

(12) United States Patent
Suzuki

(10) Patent No.: US 8,864,269 B2
(45) Date of Patent: Oct. 21, 2014

(54) PRINTING APPARATUS AND CONTROL METHOD THEREOF

(75) Inventor: Hiroshi Suzuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 13/535,022

(22) Filed: Jun. 27, 2012

(65) Prior Publication Data

US 2013/0033537 A1 Feb. 7, 2013

(30) Foreign Application Priority Data

Aug. 4, 2011 (JP) ..... 2011-171103

(51) Int. Cl.
*B41J 11/46* (2006.01)
*B41J 29/17* (2006.01)

(52) U.S. Cl.
CPC ..... *B41J 29/17* (2013.01)
USPC ..... 347/16

(58) Field of Classification Search
None
See application file for complete search history.

(56) References Cited

U.S. PATENT DOCUMENTS 7,123,872 B2 * 10/2006 Shakuto et al. ..... 399/350
7,560,398 B2 * 7/2009 Zillig et al. ..... 442/61
7,677,717 B2 * 3/2010 Islam et al. ..... 347/103
8,158,043 B2 * 4/2012 Gibson et al. ..... 264/156
2006/0290735 A1 12/2006 Jang

FOREIGN PATENT DOCUMENTS

| | | | |
|---|---|---|---|
| CN | 1915671 | A | 2/2007 |
| JP | 2000-272106 | A | 10/2000 |
| JP | 2001-047691 | A | 2/2001 |
| JP | 2004-025666 | A | 1/2004 |
| JP | 2007-144673 | A | 6/2007 |

* cited by examiner

*Primary Examiner* — Lamson Nguyen
(74) *Attorney, Agent, or Firm* — Canon USA, Inc., IP Division

(57) ABSTRACT

A printing apparatus includes a printing unit, a platen, and a conveyance unit. The printing unit discharges ink for printing. The platen supports a sheet in the printing unit. The conveyance unit includes a first roller and a second roller arranged on a downstream side of the first roller and conveys the sheet along a conveyance path including a route from a sheet feed unit to the printing unit. In a cleaning mode to clean the platen, the printing apparatus conveys a cleaning sheet fed from the sheet feed unit until a trailing edge of the cleaning sheet reaches at least a position downstream of a nip position of the first roller, and then to reciprocate the cleaning sheet at least once by the second roller with such a stroke as not to allow the trailing edge to return to the nip position of the first roller.

16 Claims, 5 Drawing Sheets

PRINTING APPARATUS AND CONTROL METHOD THEREOF

BACKGROUND OF THE INVENTION

1. Field of the Invention

The present invention relates to a printing apparatus that can execute a cleaning mode for a platen.

2. Description of the Related Art

In an inkjet printing apparatus, a platen for supporting a sheet can be stained with ink mist generated during printing or ink discharged outside the sheet. If printing continues with the platen stained, the stain can adhere to the rear surface of the sheet.

In order to solve the problem, as discussed in Japanese Patent Application Laid-Open No. 2004-025666, a cleaning sheet that easily absorbs ink is provided, the cleaning sheet is passed through a conveyance path, and conveyance is controlled to reciprocate the sheet leading edge on the platen. Thus, the leading edge of the cleaning sheet wipes the surface of the platen to remove the stain.

In a typical printing apparatus, a plurality of conveyance rollers is arranged on a conveyance path on which a sheet is picked up from a sheet feed unit and the sheet is conveyed to a printing unit. In the configuration, when cleaning a platen by the reciprocation as discussed in Japanese Patent Application Laid-Open No. 2004-025666, the trailing edge of the cleaning sheet that is sent back hits a conveyance roller without properly being nipped by the conveyance roller. Thus, the sheet trailing edge can be folded or a sheet conveyance jam can occur.

In particular, the problem can become serious when a plurality of conveyance rollers is rotated by a shared single motor to downsize an apparatus and pursue cost reduction. In the configuration, conveyance rollers near the printing unit are rotated forward or backward according to a rotational direction of the motor, but conveyance rollers on the upstream side thereof are rotated only forward, irrespective of the rotational direction of the motor.

In the configuration, when cleaning the platen by the reciprocation as discussed in Japanese Patent Application Laid-Open No. 2004-025666, when the trailing edge of the cleaning sheet, sent back by rotating backward the conveyance roller on the downstream side, reaches the conveyance roller on the upstream side, the conveyance roller on the upstream side is rotated forward. Therefore, the sheet hits the conveyance roller without being nipped, thus increasing the possibility that the sheet trailing edge is folded or the sheet conveyance jam occurs. If the platen cleaning is started when the sheet is nipped by both the conveyance rollers on the upstream and downstream sides, the sheet feed direction is different between the rollers on the upstream and downstream sides. Therefore, the sheet can sag in the middle thereof and the sheet conveyance jam can occur with a high possibility.

Also as discussed in Japanese Patent Application Laid-Open No. 2004-025666, the leading edge of the cleaning sheet is reciprocated on the platen. If the cleaning sheet in use curls upward, the sheet leading edge floats up and does not come into contact with the platen. This reduces a cleaning effect. If the sheet leading edge further floats up, the sheet leading edge can hit a print head. This is because the sheet is held only by the conveyance roller on the upstream side in the printing unit, and the sheet is reciprocated in an unstable conveyance state.

SUMMARY OF THE INVENTION

The present invention is directed to a printing apparatus that is capable of cleaning a platen with a high reliability.

According to an aspect of the present invention, a printing apparatus includes a printing unit configured to discharge ink for printing, a platen configured to support a sheet in the printing unit, and a conveyance unit including a first roller and a second roller arranged on a downstream side of the first roller, configured to convey the sheet along a conveyance path including a route from a sheet feed unit to the printing unit, wherein the printing apparatus is capable of executing a cleaning mode for cleaning the platen and, in the cleaning mode, the printing apparatus is controlled to convey, by the conveyance unit, a cleaning sheet fed from the sheet feed unit until a trailing edge of the cleaning sheet reaches at least a position downstream of a nip position of the first roller, and then to reciprocate the cleaning sheet at least once by the second roller with such a stroke as not to allow the trailing edge to return to the nip position of the first roller.

According to an exemplary embodiment of the present invention, when the cleaning sheet is reciprocated, the trailing edge does not return to the position of the first roller. Therefore, the platen cleaning can be performed with a high reliability.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
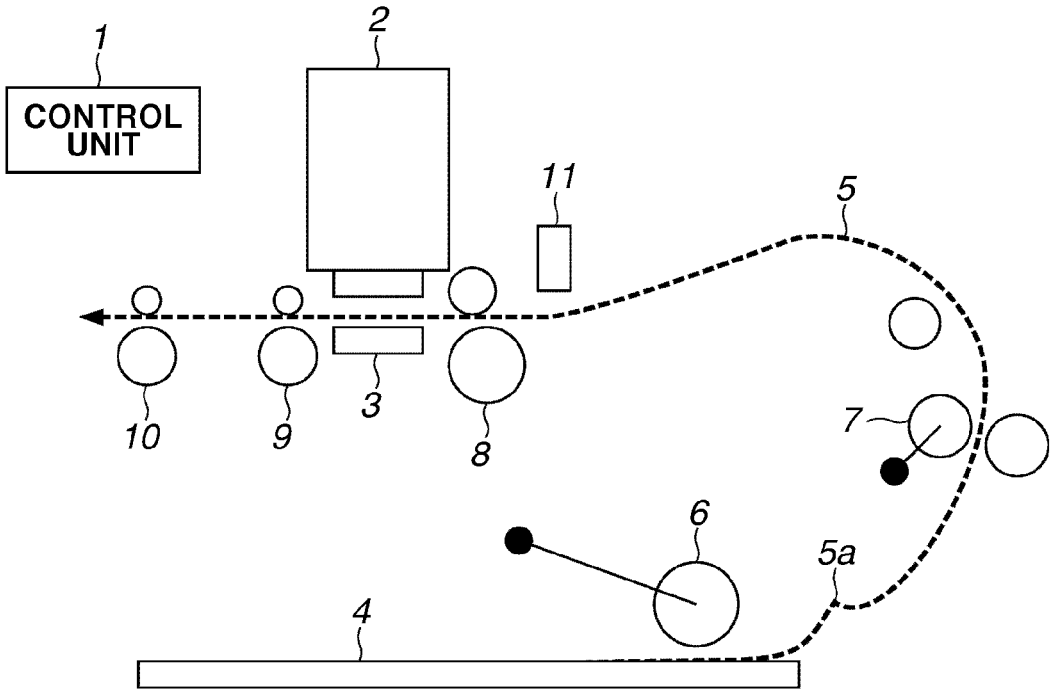
FIG. 1 illustrates a configuration diagram of a printing apparatus according to an exemplary embodiment.

A description is given of a printing apparatus according to an exemplary embodiment. FIG. 1 illustrates a cross-sectional view of a configuration of the printing apparatus according to the exemplary embodiment. Roughly, the printing apparatus includes a sheet feed unit, a printing unit, a conveyance mechanism that conveys a sheet along a conveyance path, and a control unit.

The sheet feed unit includes a sheet cassette 4 that stores a plurality of sheets cut by a predetermined size, and a pickup roller 6 that picks up one sheet from the sheet cassette 4 to send the sheet. The sheet cassette 4 can support various sheet sizes such as A4, A5, B4, B5, and some other sizes.

The sheet sent from the sheet feed unit is conveyed along a conveyance path including a route toward the printing unit by the conveyance mechanism. In the present specification, at an arbitrary position of the conveyance path, the side of the sheet near the sheet cassette 4 as a sheet feeder is referred to as an "upstream" side, and the opposite side of the sheet is referred to as a "downstream" side.

The printing unit includes a print head 2 that discharges ink by an inkjet method, and a carriage (not illustrated) that holds the print head 2 and moves the print head 2 in the direction perpendicular to the drawing surface of FIG. 1. The print head 2 has energy generation elements, such as a heating element, a piezoelectric element, an electrostatic element, and a micro-electro-mechanical system (MEMS) element. The printing unit further includes a platen 3 that faces the print head 2 for supporting a moving sheet 5 by keeping the sheet flat. In an example, the width of a sheet supporting surface of the platen 3 in the sheet conveyance direction is 50 mm.

The conveyance mechanism includes a conveyance roller 7 having a pair of rollers that nips the sheet on the upstream side of the sheet at a nip position of the conveyance roller 7 and conveys the sheet, a conveyance roller 8 having a pair of rollers that nips the sheet on the downstream side of the sheet and conveys the sheet, and a conveyance roller 9 having a pair of rollers in the conveyance path that contains the route between the sheet feed unit and the printing unit. In the printing unit, the conveyance roller 8 is arranged on the upstream side of the platen 3, and the conveyance roller 9 is arranged on the downstream side of the platen 3. In the present specification, the conveyance roller 7 is referred to as a first roller, the conveyance roller 8 is referred to as a second roller, and the conveyance roller 9 is referred to as a third roller. The conveyance mechanism further includes a discharge roller 10 that externally discharges the sheet from the printing unit. In an example, the distance along the conveyance path between the platen edge on the upstream side of the sheet supporting surface of the platen 3 and the nip position of the conveyance roller 7 is designed to be longer than 74.25 mm (a quarter of the 297 mm length of the longer side of an A4-size sheet).

The pickup roller 6, the conveyance roller 7, the conveyance roller 8, the conveyance roller 9, and the discharge roller 10 are rotated by a drive force transmitted thereto with a drive transmission mechanism containing a single conveyance motor 12 (not illustrated in FIG. 1) common to all of the rollers and a gear train. The conveyance roller 8, the conveyance roller 9, and the discharge roller 10 are rotated forward or backward according to a rotational direction of the conveyance motor 12, where the rotational direction of the conveyance motor 12 for conveying the sheet to the downstream side is referred to as the forward direction and the rotational direction for conveying the sheet to the upstream side is referred to as the reverse direction. On the other hand, the pickup roller 6 and the conveyance roller 7 are rotated only forward, irrespective of the rotational direction of the conveyance motor 12. Thus, the conveyance roller 7 and the conveyance roller 8 are driven by the common motor, the conveyance roller 7 is rotated only in a rotational direction for sending the sheet to the downstream side, and the conveyance roller 8 is rotated by switching the rotational direction for sending the sheet to the downstream side and the rotational direction for sending the sheet back to the upstream side. The switching of the rotational direction of the roller is not limited to a switching system of the rotational direction of the conveyance motor 8, and such a mechanism may be used to continuously keep the rotational direction of the conveyance motor in one direction and switch the rotational direction by the drive transmission mechanism in the middle thereof. The pickup roller 6 and the conveyance roller 7 can release the sheet with a lift mechanism.

In the conveyance path, at a predetermined detection position between the conveyance roller 7 and the conveyance roller 8, a sheet sensor 11 is arranged to detect the passage of the sheet leading edge (edge on the downstream side) and the sheet trailing edge (edge on the upstream side). In an example, the predetermined detection position is 20 mm upstream from the nip position of the conveyance roller 8.

According to the present exemplary embodiment, the printing apparatus alternately performs sub-scanning for step-feeding the sheet by the conveyance roller 8 and main scanning for moving the carriage and discharging the ink from the print head 2, thereby printing an image based on a serial printing system for forming an image on the sheet. The image may be printed based on a line printing system using the print head 2 as a line head as well as the serial printing system. The sheet on which the image is printed by the printing unit is discharged out of the printing apparatus by the discharge roller 10.

The control unit 1 controls the entire printing apparatus. The control unit 1 may be included in the printing apparatus, or may be obtained by installing control software to a host computer connected to the printing apparatus.

Figure 2:
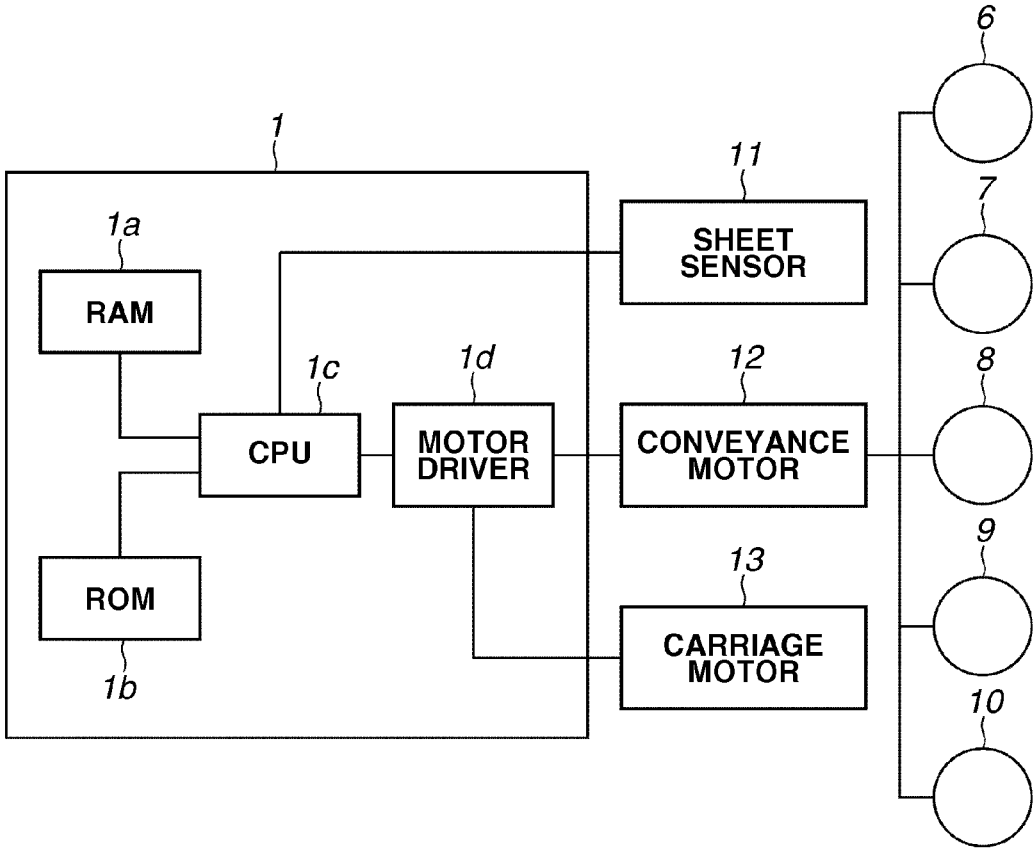
FIG. 2 illustrates a system block diagram including a control unit.

FIG. 2 illustrates a system block diagram including the control unit 1. The control unit 1 includes a read only memory (ROM) 1*b* that stores a motor drive table or data such as a drive parameter as well as the control program, a random access memory (RAM) 1*a* that temporarily stores data for operation, and a central processing unit (CPU) 1*c* that performs control and calculation under the control program. The CPU 1*c* receives a detection signal from the sheet sensor 11, and controls driving of the conveyance motor 12 and a carriage motor 13 via a motor driver 1*d*. The carriage motor 13 generates drive force that moves the carriage. As mentioned above, the pickup roller 6, the conveyance roller 7, the conveyance roller 8, the conveyance roller 9, and the discharge roller 10 are rotated in the respective predetermined directions with rotation of the conveyance motor 12.

According to the present exemplary embodiment, the printing apparatus can execute a platen cleaning mode as well as a normal image print mode as operation modes under the control of the control unit 1. In the platen cleaning mode, the sheet for cleaning (referred to as a cleaning sheet) is fed to the printing unit from the sheet feed unit, and is reciprocated with a predetermined stroke at least once, thereby automatically performing an operation for cleaning ink stain on the platen surface.

Figure 3:
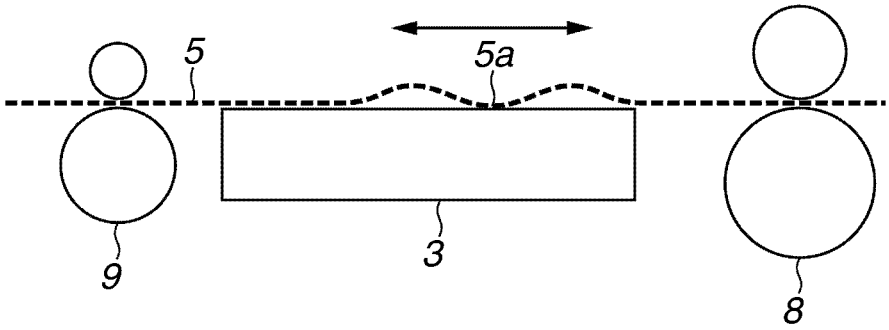
FIG. 3 illustrates a state of a printing unit when a platen cleaning mode is executed.

FIG. 3 illustrates a state of the printing unit when the platen cleaning mode is executed. A peak (projected edge) of a folding 5*a* formed by partly folding the cleaning sheet moves while contacting the sheet supporting surface of the platen 3 so that the folding 5*a* can function as a cleaning wiper. As a consequence, the platen 3 is efficiently wiped.

Prior to executing the cleaning, a user sets the cleaning sheet on the uppermost portion of the sheet cassette 4. In an example, the cleaning sheet is a 210×297 mm, A4-size regular sheet or a special sheet with high moisture-absorption property. In advance of setting the cleaning sheet on the uppermost portion of the sheet cassette 4, the user makes a folding on the cleaning sheet along the short side direction of the sheet at around a position of a quarter of the distance in the longer side direction from the sheet trailing edge (the most downstream side in the conveyance direction), or three quarters of the distance in the longer side direction of the sheet from the sheet leading edge. When making the folding on the sheet, the user first folds the entire sheet to half, and then folds a half region on the trailing edge side (downstream side) to half, thereby easily making the folding near a position of a quarter of the distance from the sheet trailing edge. Alternatively, the user may repeat folding the entire sheet to half twice to obtain the folding lines that equally divide the entire sheet into four parts.

The user sets the cleaning sheet on the sheet cassette 4 so that the peak of the folding 5*a* is upward on the sheet cassette 4. Thus, when the sheet reaches the platen 3 as in FIG. 3, the peak of the folding 5*a* is downward, facing the surface of the platen 3. The cleaning sheet is set in the direction for positioning the folding 5*a* at a quarter of the distance from the sheet trailing edge.

The folding position of the sheet is at a quarter of the distance from the sheet trailing edge to establish both the operability for the user who makes the folding and the downsizing of the apparatus. The user can make the folding at a quarter of the distance from the sheet trailing edge by folding the sheet to half twice with a small troublesomeness. For any distance except for a quarter of the distance, the work troublesomeness and the level of difficulty will be higher, and the folding cannot easily be made at an accurate position. In addition, reducing the distance from the folding to the sheet trailing edge can prevent the sheet trailing edge from reaching the nip position of the conveyance roller 7 with the reciprocation cleaning. In other words, the distance of the conveyance path between the conveyance roller 7 and the conveyance roller 8 can be reduced, thereby realizing the downsizing of the printing apparatus.

The folding is made in the middle of the sheet and the platen 3 is wiped with the peak of the folding 5*a*. Therefore, as compared with the conventional cleaning with the sheet leading edge, the cleaning can be performed with a higher reliability. In the conventional cleaning with the sheet edge, if the sheet curls upward, the sheet leading edge thus floats up and does not come into contact with the platen 3. This reduces the cleaning effect. If the sheet leading edge further floats up, the sheet leading edge can hit the print head 2.

In addition, according to the present exemplary embodiment, during the cleaning, the cleaning sheet is reciprocated with both the upstream and downstream sides of the sheet folding nipped by the conveyance roller 8 and the conveyance roller 9 in the printing unit. This, the reciprocation can be stable. In the conventional cleaning with the sheet edge, the reciprocation is unstable because the sheet is held only by the conveyance roller arranged on either the upstream side or the downstream side in the printing unit.

Figure 4:
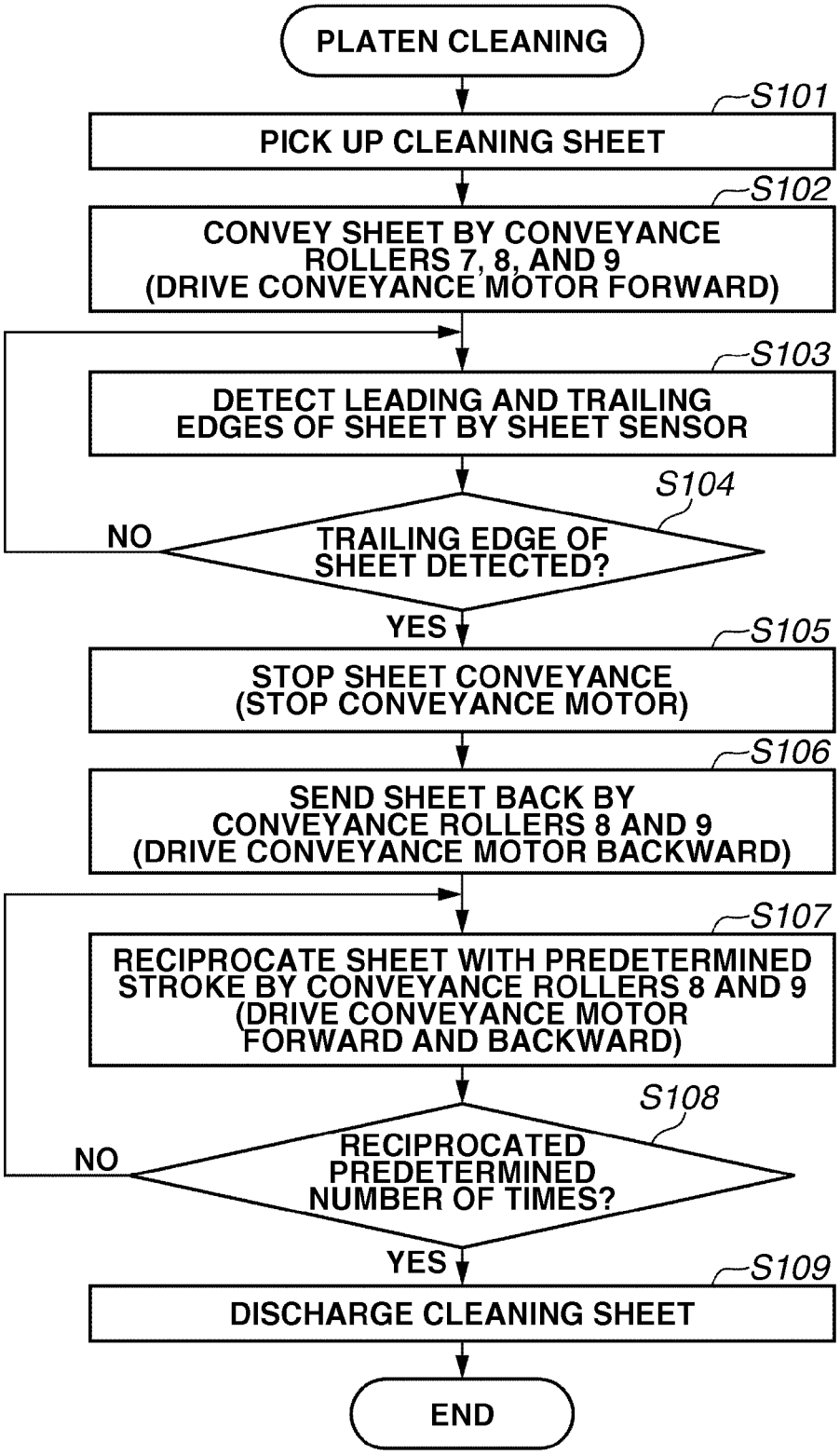
FIG. 4 illustrates a flowchart illustrating an operational sequence in a platen cleaning mode.

FIG. 4 illustrates a flowchart illustrating an operational sequence of the printing apparatus of FIG. 1 in the platen cleaning mode. These operations are performed under the control of the control unit 1. Prior to executing the cleaning, the sequence starts in a state in which the user sets the cleaning sheet on the uppermost part of the sheet cassette 4.

In step S101, the pickup roller 6 picks up the cleaning sheet set on the sheet cassette 4, and sends the sheet to the conveyance path.

In step S102, the cleaning sheet is conveyed along the conveyance path from the sheet feed unit to the printing unit. This operation is performed by driving the conveyance motor 12 forward to rotate the conveyance roller 7, the conveyance roller 8, and the conveyance roller 9 forward. Note that in FIG. 1, the peak of the folding 5*a* is upward of the sheet cassette 4 when the cleaning sheet is just off the sheet cassette 4.

In step S103, the sheet sensor 11 detects the sheet leading edge or the sheet trailing edge of the cleaning sheet such that, after first detecting the sheet leading edge, the sheet sensor 11 may eventually detect the sheet trailing edge of the cleaning sheet. When the sheet leading edge first passes through the sensor detection position, the sheet sensor 11 generates a first detection signal. When the sheet trailing edge then passes through the sensor detection position, the sheet sensor 11 generates a second detection signal. The CPU 1*c* of the control unit 1 is configured to make several determinations based on the first and second detection signal. For example, in response to the first detection signal being generated, the control unit 1 determines that the sheet is conveyed through the conveyance path without a sheet conveyance jam. With the second detection signal generated, the control unit 1 determines that the cleaning sheet is conveyed without a sheet conveyance jam and the trailing edge of the sheet conveyed through the conveyance path is positioned at least farther downstream than the nip position of the conveyance roller 7. Further, with the amount of sheet conveyance during the timings of generation between the first detection signal and the second detection signal, the control unit 1 can estimate a size of the sheet in the conveyance direction. Based on the generation of the detection signals, the control unit 1 controls the conveyance.

As noted, after detecting the sheet leading edge, the sheet sensor 11 may eventually detect the sheet trailing edge of the cleaning sheet. In step S104, the sheet sensor 11 determines whether the sheet trailing edge of the cleaning sheet is detected. If the determination indicates NO in step S104, the processing returns to step S103 and then repeats until the determination in step S104 indicates YES. If the determination indicates YES in step S104, the processing proceeds to step S105. The process may include a time out where, if step S103 continues to repeat beyond a predetermined time or number of repeats, the control unit 1 may end the platen cleaning process and send a notification to the user.

In step S105, after the sheet trailing edge is detected in step S104, the rotation of the conveyance motor 12 is immediately suspended to stop the conveyance of the sheet. On the stopping cleaning sheet, the folding 5*a* is positioned at least downstream of the sheet supporting surface of the platen 3, and the sheet trailing edge is positioned on the upstream side of the nip position of the conveyance roller 8.

In step S106, the conveyance motor 12 is driven backward, the conveyance roller 8 and the conveyance roller 9 are rotated backward, and the cleaning sheet is thus sent back towards the upstream side. The distance that the sheet is sent back corresponds to movement of the folding 5*a* of the cleaning sheet stopped in step S105 to the platen edge on the downstream side of the sheet supporting surface of the platen 3. Since the folding position is known as a quarter of the distance from the sheet trailing edge in the longer side direction of the sheet (74.25 mm for A4-size sheet), the value of the distance that the sheet is sent back is fixed as a fixed distance value. The motor driving amount required for the distance movement is stored in advance in a memory in the control unit 1.

If the user sets any sheet except for the A4-size sheet as the cleaning sheet, in step S106, the folding 5*a* cannot accurately be sent to the edge of the platen 3 on the downstream side using the fixed distance value. In step S103, the sheet length is estimated based on the timings of detection for the sheet leading and trailing edges by the sheet sensor 11. If the sheet length is different from the standard size (A4 size), the subsequent cleaning operation may be suspended. Alternatively, even if the size of the cleaning sheet is different from the original one, it is highly possible that the folding 5*a* made by the user desirably is at a quarter of the distance from the sheet trailing edge. Thus, depending on the sheet length estimated by the sheet sensor 11, the control unit 1 may change the distance that the sheet is sent back in step S106 so that the folding 5*a* is moved to the platen edge on the downstream side of the platen 3.

In step S107, the conveyance roller 8 and the conveyance roller 9 reciprocate the cleaning sheet between the upstream side and the downstream side with a predetermined stroke. This operation is executed by iteratively alternating the forward and backward rotational directions of the conveyance motor 12. The predetermined stroke corresponds to a distance that covers at least a range from the platen edge on the upstream side of the sheet supporting surface of the platen 3 to the platen edge on the downstream side for the folding position of the cleaning sheet. Thus, the predetermined stroke corresponds to a length equal to or greater than the width (e.g., 50 mm) of the platen 3 in the sheet conveyance direction. The motor driving amount required for the distance movement is stored in advance in the memory in the control unit 1. With the reciprocation of the cleaning sheet, as illustrated in FIG. 3, the sheet supporting surface of the platen 3 is wiped while the peak (projected and pointed edge) of the folding 5*a* contacts the sheet supporting surface of the platen 3.

In step S108, the reciprocation in step S107 is repeated a predetermined number of times to enhance the cleaning effect of the platen 3. Although the predetermined number of times is four according to the present exemplary embodiment, the predetermined number of times may be another, such as by taking into account the ink in the ink mist and surface and other features of the cleaning sheet. If fully achieving the cleaning effect by a single reciprocation, step S108 may be omitted.

In step S109, the conveyance motor 12 is rotated forward, and the cleaning sheet is discharged by the discharge roller 10. Then, the platen cleaning process of FIG. 4 ends.

With the detection by the sheet sensor 11, it can be recognized that the sheet trailing edge passes through the conveyance roller 7. Further, the reciprocation stroke is set to such a distance as not to allow the sheet trailing edge to return to the nip position of the conveyance roller 7. Therefore, when the cleaning sheet is reciprocated, the sheet trailing edge does not return to the position of the first roller. This prevents the sheet sent back by the reciprocation from hitting the conveyance roller 7, being improperly nipped by the conveyance roller 7, the sheet trailing edge from being folded, or the sheet conveyance jam from occurring. Thus, the platen cleaning is executed with a high reliability.

Figure 5:
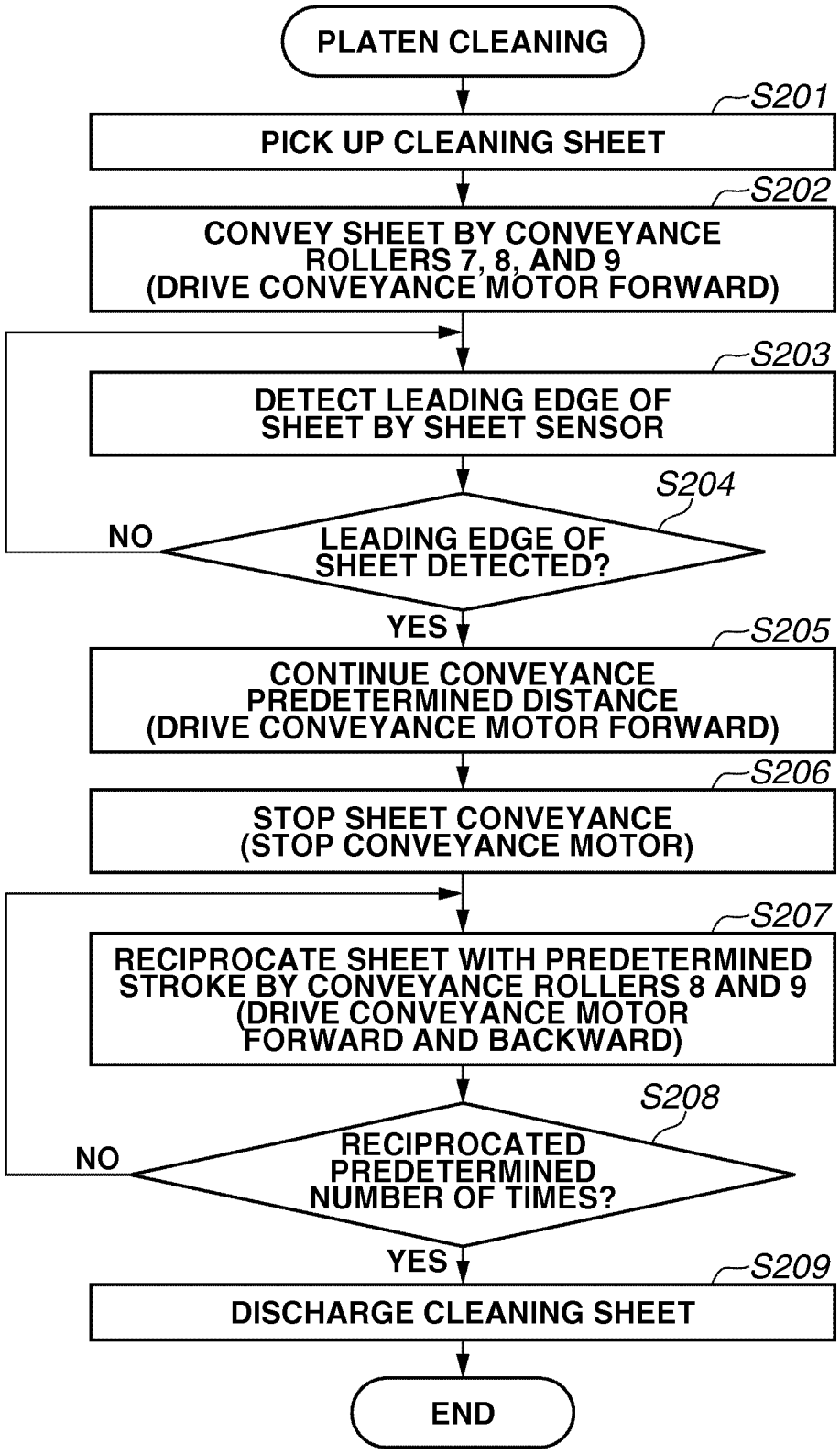
FIG. 5 illustrates a flowchart illustrating another operational sequence in the platen cleaning mode.

FIG. 5 illustrates a flowchart of another example of the operational sequence in the platen cleaning mode. The operations are under control of the control unit 1. The difference from the sequence in FIG. 4 is mainly described.

Processing in steps S201 to S202 is similar to that in steps S101 to S102 in FIG. 4. In step S203, the sheet sensor 11 detects the sheet leading edge of the cleaning sheet. Unlike the operation in FIG. 4, the sheet sensor 11 does not detect the sheet trailing edge.

Before the cleaning sheet reaches the sheet sensor 11, the sheet sensor 11 will not have detected the sheet leading edge. In step S204, the sheet sensor 11 determines whether the sheet leading edge is detected. If the determination indicates NO in step S204, the processing returns to step S203 and then repeats until the determination indicates YES in step S204. If the determination indicates YES in step S204, the processing proceeds to step S205.

In step S205, the rotation of the conveyance motor 12 continues to keep the conveyance by a predetermined distance even after the sheet leading edge is detected in step S204. In step S206, the rotation of the conveyance motor is suspended to stop the sheet conveyance.

With the predetermined distance, the folding 5*a* of the cleaning sheet is positioned on the downstream side of the sheet supporting surface of the platen 3, and the sheet trailing edge is positioned on the upstream side of the nip position of the conveyance roller 8. The size of the cleaning sheet in use is predetermined, the value of the predetermined distance therefore is fixed, and the motor driving amount required for the distance movement is stored in advance in the memory in the control unit 1.

If the user sets any sheet except for the A4-size sheet as the cleaning sheet, in steps S205 and S206, the folding 5*a* cannot be sent accurately to the downstream side of the platen 3 using the fixed value of the predetermined distance. In response to the user using a cleaning sheet other than the A4-size sheet, the sheet sensor 11 may also detect the sheet trailing edge in step S205 during the sheet conveyance, and may estimate the sheet length based on the timings of detection for the sheet leading edge and the sheet trailing edge. If the estimated sheet length is different from the standard size (A4 size), the subsequent cleaning operation may be suspended. In an alternative, it is highly possible that, although the size of the cleaning sheet is different from the original one, the user desirably makes the folding at a quarter of the distance from the sheet trailing edge. Then, the stop position in step S206 may be dynamically changed so that the folding 5*a* is on the downstream side of the platen 3 depending on the sheet length estimated by the sheet sensor 11.

In step S207, similarly to step S107, the conveyance roller 8 and the conveyance roller 9 reciprocate the cleaning sheet between the upstream side and the downstream side with a predetermined stroke. The predetermined stroke is as mentioned above, and the motor driving amount required for the movement is stored in advance in the memory in the control unit 1.

In step S208, the reciprocation in step S207 is repeated a predetermined number of times. If the cleaning effect is fully achieved by a single reciprocation, step S208 may be omitted. In step S209, the cleaning sheet is discharged. Then, the platen cleaning process of FIG. 5 ends.

The sheet trailing edge passes through the conveyance roller 7 without fail by continuing the conveyance by the predetermined distance corresponding to the sheet size after the sheet sensor 11 detects the sheet leading edge. Thus, the similar operational effects to those in FIG. 4 can be obtained.

According to a modification of the present exemplary embodiment, the conveyance in the cleaning operation can be controlled without detection of the sheet sensor 11. The distances of the conveyance path from the sheet feed unit (pickup roller 6) to the conveyance roller 7, the sheet sensor 11, the conveyance roller 8, the platen 3, and the conveyance roller 9 are individually predetermined as fixed values. Therefore, based on the conveyance control amount after the sheet is sent from the pickup roller 6, it can be estimated where the sheet trailing edge is on the conveyance path.

According to the modification of the exemplary embodiment, the size of the cleaning sheet in use needs to be predetermined. The size of the cleaning sheet may only be a predetermined size (e.g., A4) and, alternatively, the user may input the size of the cleaning sheet in use to the printing apparatus before executing the cleaning. The sheet is first conveyed from the sheet feed unit to the printing unit by the distance corresponding to the sheet size. If the user sets a sheet larger than the original one and executes the cleaning, the sheet trailing edge cannot completely pass through the conveyance roller 7 or the sheet trailing edge can reach the nip position of the conveyance roller 7 when the cleaning sheet is reciprocated. According to the present exemplary embodiment that uses the sheet sensor 11 for detecting the sheet position, the above-mentioned possibility can be eliminated.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-171103 filed Aug. 4, 2011, which is hereby incorporated by reference herein in its entirety.

What is claimed is:

1. A printing apparatus comprising:

a printing unit configured to discharge ink for printing;

a platen configured to support a sheet in the printing unit; and a conveyance unit including a first roller and a second roller arranged on a downstream side of the first roller, configured to convey the sheet along a conveyance path including a route from a sheet feed unit to the printing unit, wherein the printing apparatus is capable of executing a cleaning mode for cleaning the platen and, in the cleaning mode, the printing apparatus is controlled to convey, by the conveyance unit, a cleaning sheet fed from the sheet feed unit until a trailing edge of the cleaning sheet reaches at least a position downstream of a nip position of the first roller, and then to reciprocate the cleaning sheet at least once by the second roller with such a stroke as not to allow the trailing edge to return to the nip position of the first roller.

2. The printing apparatus according to claim 1, wherein a common motor is provided to drive the first roller and the second roller, and wherein the first roller is rotatable by the common motor forward for sending the cleaning sheet to the downstream side, while the second roller is rotatable by the common motor forward and backward by switching between a rotational direction for sending the cleaning sheet to the downstream side and a rotational direction for sending the cleaning sheet back to an upstream side.

3. The printing apparatus according to claim 1, wherein the printing apparatus is capable of recognizing that the trailing edge of a sheet conveyed in the conveyance path is positioned downstream of the nip position of the first roller, and wherein the conveyance unit conveys the cleaning sheet until the printing apparatus recognizes that the trailing edge reaches at least a position downstream of the nip position of the first roller.

4. The printing apparatus according to claim 1, further comprising:

a sensor configured to detect a leading edge or a trailing edge of the sheet at a detection position on the downstream side of the nip position of the first roller and an upstream side of a nip position of the second roller in the conveyance path, wherein a conveyance distance is controlled based on the detection by the sensor.

5. The printing apparatus according to claim 4, wherein, in response to the cleaning sheet being conveyed from the sheet feed unit and the sensor then detecting the trailing edge, the printing apparatus is controlled to suspend conveyance of the cleaning sheet, send back the cleaning sheet by a predetermined distance, and then perform the reciprocation.

6. The printing apparatus according to claim 4, wherein after the sensor detects the leading edge of the cleaning sheet, the printing apparatus is controlled to continue conveyance of the cleaning sheet by a predetermined distance corresponding to a length in a conveyance direction of the cleaning sheet in use, suspend the conveyance, and then perform the reciprocation.

7. The printing apparatus according to claim 6, wherein a length in the conveyance direction of the cleaning sheet is estimated based on timings of detection for the leading edge and the trailing edge by the sensor.

8. The printing apparatus according to claim 4, wherein a length in a conveyance direction of the cleaning sheet is estimated based on timings of detection for the leading edge and the trailing edge by the sensor, and, in response to the estimated length being different from a standard size, the printing apparatus is controlled not to perform the reciprocation.

9. The printing apparatus according to claim 1, wherein a position of the trailing edge of the cleaning sheet is estimated based on a length in a conveyance direction of the cleaning sheet in use and amount of conveyance control by which the conveyance unit sends the cleaning sheet from the sheet feed unit, and wherein the printing apparatus is controlled to suspend the conveyance, and then perform the reciprocation.

10. The printing apparatus according to claim 1, wherein, in response to the trailing edge being positioned at least downstream of the nip position of the first roller and upstream of a nip position of the second roller, the printing apparatus is controlled to suspend the conveyance and then perform the reciprocation.

11. The printing apparatus according to claim 1, wherein the cleaning sheet has a peak of a folding on a side thereof facing the platen, and the peak of the folding wipes a surface of the platen.

12. The printing apparatus according to claim 11, wherein the printing apparatus is controlled to perform the reciprocation after the peak of the folding reaches a downstream side of the platen.

13. The printing apparatus according to claim 11, wherein the folding is provided around a position of a quarter of a sheet length from the trailing edge of the cleaning sheet.

14. The printing apparatus according to any one of claim 1, wherein the stroke corresponds to a length equal to or greater than a width of the platen in a sheet conveyance direction.

15. The printing apparatus according to claim 1, wherein the conveyance unit includes the second roller arranged on an upstream side of the platen and a third roller arranged on a downstream side of the platen in the printing unit, and wherein the reciprocation is performed with the cleaning sheet nipped by both the second roller and the third roller in the cleaning mode.

16. A control method for a printing apparatus, the printing apparatus including a printing unit configured to discharge ink for printing, a platen configured to support a sheet in the printing unit, and a first roller and a second roller arranged on a downstream side of the first roller, configured to convey the sheet along a conveyance path including a route from a sheet feed unit to the printing unit, wherein the printing apparatus is capable of executing a cleaning mode for cleaning the platen, the control method comprising:

conveying, in the cleaning mode, a cleaning sheet fed from the sheet feed unit until a trailing edge of the cleaning sheet reaches at least a position downstream of the first roller, and then reciprocating the cleaning sheet at least once by the second roller with such a stroke as not to allow the trailing edge to return to a position of the first roller.

* * * * *